US007843420B2

(12) United States Patent
Chen et al.

(10) Patent No.: US 7,843,420 B2
(45) Date of Patent: Nov. 30, 2010

(54) LCD WITH SOURCE DRIVER AND DATA TRANSMITTING METHOD THEREOF

(75) Inventors: Chien-Ru Chen, Tainan County (TW); Ying-Lieh Chen, Tainan County (TW); Lin-Kai Bu, Tainan County (TW)

(73) Assignee: Himax Technologies Limited, Tainan County (TW)

( * ) Notice: Subject to any disclaimer, the term of this patent is extended or adjusted under 35 U.S.C. 154(b) by 809 days.

(21) Appl. No.: 11/802,979

(22) Filed: May 29, 2007

(65) Prior Publication Data

US 2008/0030453 A1 Feb. 7, 2008

(30) Foreign Application Priority Data

Aug. 7, 2006 (TW) ..... 95128890 A

(51) Int. Cl.
*G09G 3/36* (2006.01)

(52) U.S. Cl. ..... 345/99; 345/100

(58) Field of Classification Search ..... 345/98–100, 345/204; 377/64

See application file for complete search history.

(56) References Cited

U.S. PATENT DOCUMENTS

| | | | | |
|---|---|---|---|---|
| 5,786,800 | A * | 7/1998 | Gyouten | 345/98 |
| 5,821,948 | A * | 10/1998 | Kawamoto et al. | 345/539 |
| 2005/0285839 | A1 * | 12/2005 | Kim | 345/100 |
| 2006/0256099 | A1 * | 11/2006 | Tashiro | 345/204 |

* cited by examiner

*Primary Examiner*—Chanh Nguyen
*Assistant Examiner*—Allison Walthall
(74) *Attorney, Agent, or Firm*—Rabin & Berdo, P.C.

(57) ABSTRACT

A data transmitting method for inputting a data signal to an electronic device. The data signal includes first and second sets of data, and the electronic device includes first to fourth receiving units and corresponding first to fourth registers. The transmitting method includes the following steps. First, the first and second receiving units are disabled. Then, the first set of data is inputted to the electronic device through the third and fourth receiving units and stored in the third and fourth registers during a first clock cycle of a clock signal. Thereafter, the second set of data is inputted to the electronic device through the third and fourth receiving units and stored in the third and fourth registers while the first set of data stored in the third and fourth registers is inputted to the first and second registers during a second clock cycle of the clock signal.

26 Claims, 9 Drawing Sheets

LCD WITH SOURCE DRIVER AND DATA TRANSMITTING METHOD THEREOF

This application claims the benefit of Taiwan application Serial No. 095128890, filed Aug. 7, 2006, the subject matter of which is incorporated herein by reference.

BACKGROUND OF THE INVENTION

1. Field of the Invention

The invention relates in general to a data transmitting method of a liquid crystal display (LCD), and more particularly to a data transmitting method of a LCD capable of reducing the number of buses between a source driver and a timing controller.

2. Description of the Related Art

FIG. 1A (Prior Art) is a partial circuit diagram showing a conventional LCD 100. FIG. 1B (Prior Art) shows timing charts of some signals of the LCD 100 of FIG. 1A. Referring to FIGS. 1A and 1B, the LCD 100 includes a timing controller 102, buses 1051 to 1058, a source driver 104 and a pixel array (not shown). The source driver 104 includes a receiver 104*a* and a line buffer 104*b*. The pixel array has pixels each including red, green and blue sub-pixels. Sub-pixel data of each color of sub-pixel includes eight sets of bit data. For example, the sub-pixel data of the red sub-pixel includes red bit data Bit0 to Bit7. In FIGS. 1A and 1B, illustrations are made by taking the associated circuit for transmitting the red bit data Bit0 to Bit7 as an example. The buses 1051 to 1058 are paired and are for respectively inputting the bit data Bit0 to Bit7 to receiving units 106 to 112 of the receiver 104*a*. Registers 114 to 120 of the line buffer 104*b* respectively receive the bit data Bit0 to Bit7 through the receiving units 106 to 112, and respectively output a plurality of output signals SO1 to SO4 during a next clock cycle of a clock signal CLK. The output signals SO1 to SO4 respectively include the bit data Bit0 and Bit1, Bit2 and Bit3, Bit4 and Bit5 and Bit6 and Bit7.

However, when the sub-pixel data of each sub-pixel includes the eight sets of bit data, 24 buses between the source driver 104 and the timing controller 102 are needed to transmit data between the source driver 104 and the timing controller 102. The buses occupy a larger layout area on a printed circuit board (PCB) so that the cost of the LCD is higher. Meanwhile, the buses make the timing controller have the higher loading.

SUMMARY OF THE INVENTION

The invention is directed to a liquid crystal display (LCD) and a data transmitting method thereof, in which a fewer buses are utilized for data transmission, and a source driver of the invention may be applied to the conventional LCD architecture according to a special data mapping method. Thus, the LCD having the source driver and the data transmitting method according to the invention have the advantages of the low cost and the lower output loading of a timing controller, and the source driver of the invention may also be advantageously applied to the conventional LCD architecture.

According to a first aspect of the present invention, a source driver of a liquid crystal display (LCD) is provided. The LCD includes a pixel array having pixels each including a sub-pixel. Sub-pixel data of the sub-pixel includes first and second bit data. The source driver includes a receiver, a line buffer and a first transmission path. The receiver includes first and second receiving units for respectively receiving the first and second bit data and outputting the first and second bit data. The line buffer includes first and second registers for respectively receiving the first and second bit data outputted from the receiver. The first transmission path electrically connects an output terminal of the first register and an input terminal of the second register. The source driver includes a first mapping operation mode. When the source driver operates in the first mapping operation mode, the second receiving unit is disabled, the first receiving unit is enabled to receive the first bit data and the second bit data, and the first transmission path is enabled to input the second bit data received by the first receiving unit to the second register.

According to a second aspect of the present invention, a data transmitting method is provided. The data transmitting method is applied to a data transmission interface to input a data signal to an electronic device. The data signal includes a first set of data and a second set of data. The electronic device includes a first receiving unit, a second receiving unit, a third receiving unit, a fourth receiving unit and corresponding first to fourth registers. This transmitting method includes the following steps. First, the first and second receiving units are disabled. Next, the first set of data is inputted to the electronic device through the third and fourth receiving units and inputted to the third register and the fourth register during a first clock cycle of a clock signal. Thereafter, the second set of data is inputted to the electronic device through the third and fourth receiving units and inputted to the third register and the fourth register while the first set of data stored in the third register and the fourth register is inputted to the first register and the second register during a second clock cycle of the clock signal.

The invention will become apparent from the following detailed description of the preferred but non-limiting embodiments. The following description is made with reference to the accompanying drawings.

DETAILED DESCRIPTION OF THE INVENTION

The data transmitting method of the liquid crystal display (LCD) according to the invention disables half of receiving units in a receiver of a source driver. Thus, the source driver receives sub-pixel data outputted from a timing controller through the halved numbers of buses and receiving units, and the object of reducing the number of buses between the timing controller and the source driver may be achieved. In the embodiments of the present invention, the data transmitting method of the LCD further enables the source driver to be applied to the conventional LCD architecture according to a special bit data mapping method.

Figure 1A:
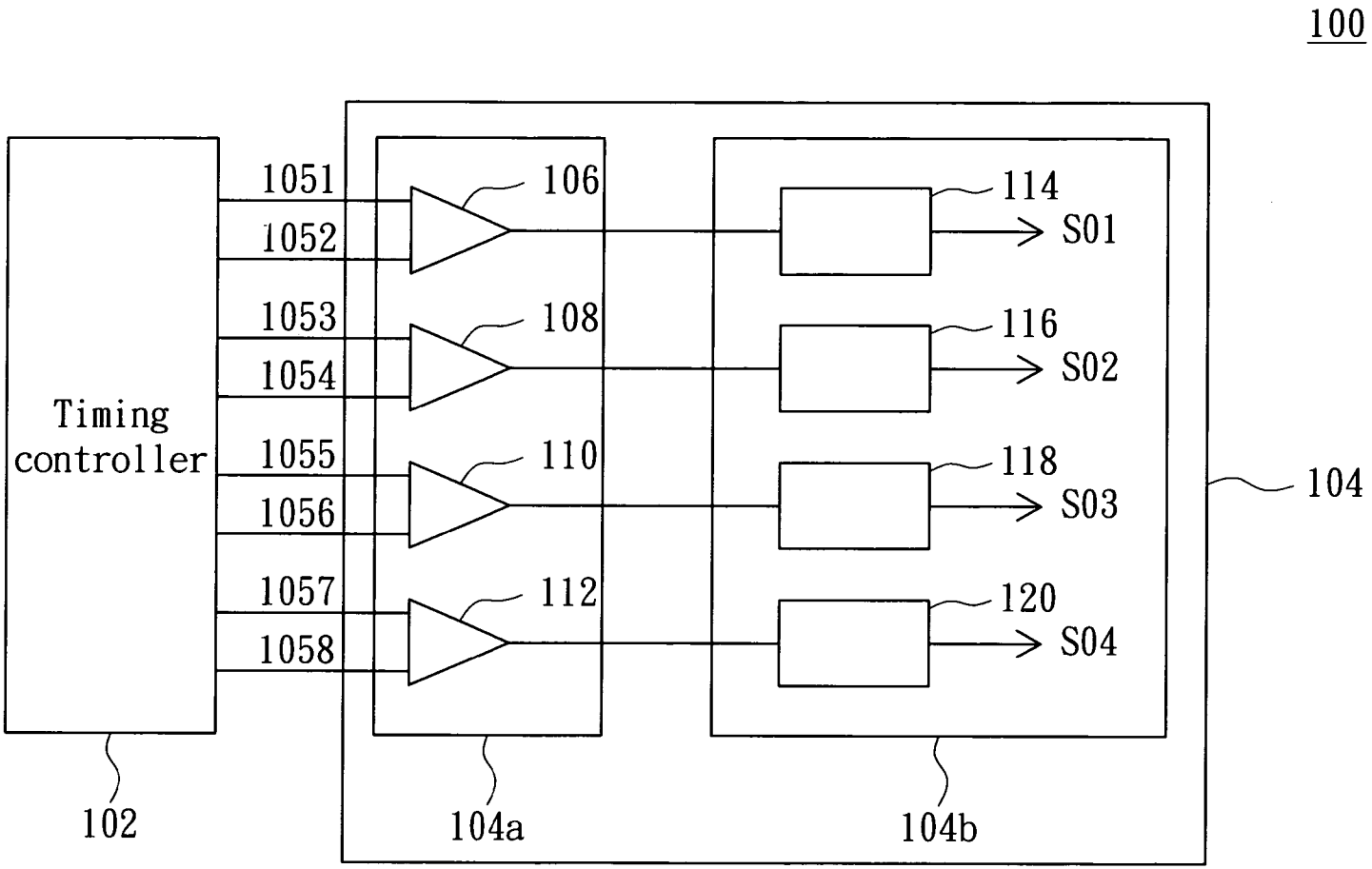
FIG. 1A(PRIOR ART)
FIG. 1A (Prior Art) is a partial circuit diagram showing a conventional LCD.
Figure 1B:
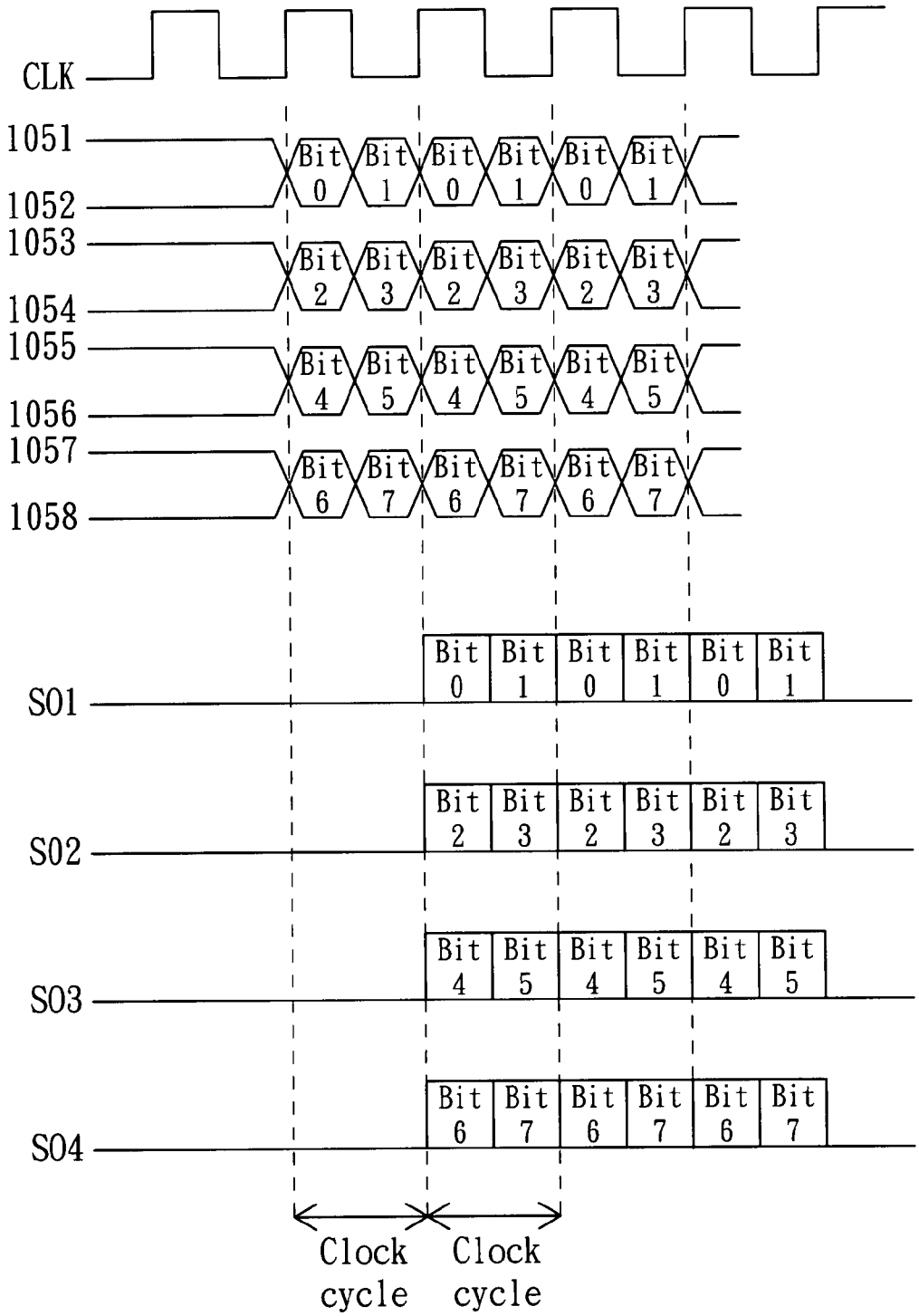
FIG. 1B(PRIOR ART)
FIG. 1B (Prior Art) shows timing charts of some signals of the LCD 100 of FIG. 1A.
Figure 2:
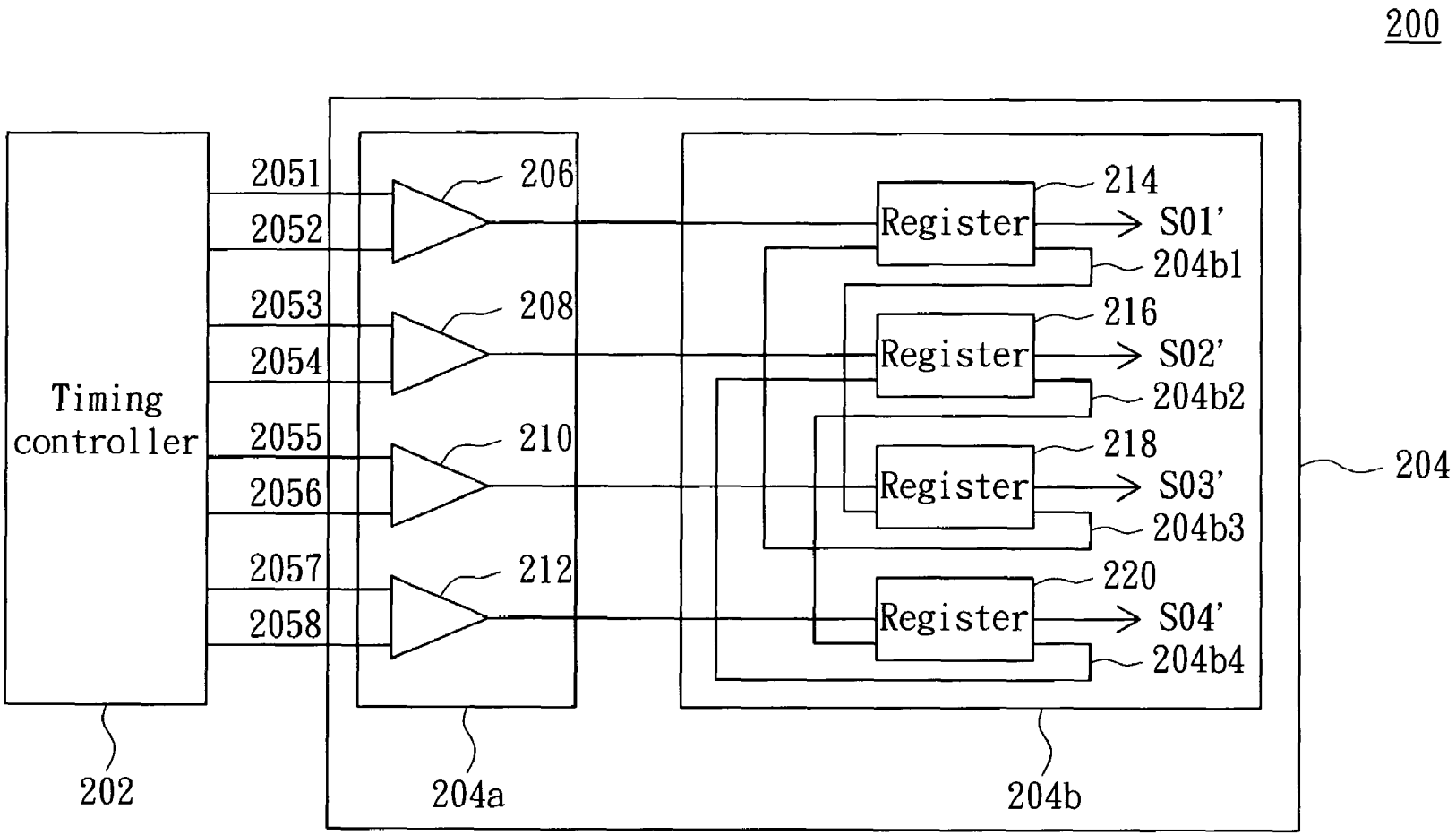
FIG. 2 is a partial circuit diagram showing a LCD 200 in the embodiments of the present invention.

FIG. 2 is a partial circuit diagram showing a LCD 200 in the embodiments of the present invention. Referring to FIG. 2, the LCD 200 includes a pixel array (not shown), a timing controller 202, buses 2051 to 2058 and a source driver 204. The timing controller 202 and the source driver 204 are controlled by a clock signal CLK to transmit sub-pixel data in the pixel array. The source driver 204 includes a receiver 204*a*, a line buffer 204*b* and transmission paths 204*b*1 to 204*b*4. The receiver 204*a* includes receiving units 206, 208, 210 and 212, and the line buffer 204*b* includes registers 214, 216, 218 and 220. The pixel array has pixels each including at least one sub-pixel. In the example of the following embodiment, each pixel of the pixel array includes a red sub-pixel.

The timing controller 202 is coupled to the receiving units 206, 208, 210 and 212 through the buses 2051 and 2052, 2053 and 2054, 2055 and 2056 and 2057 and 2058, respectively, to input the red sub-pixel data to the source driver 204. The red sub-pixel data includes, for example, bit data Bit0 to Bit7. The receiving units 206 to 212 correspond to the registers 214 to 220 and are coupled to input terminals of the registers 214 to 220, respectively. The transmission paths 204*b*1, 204*b*2, 204*b*3 and 204*b*4 are coupled to output terminals of the registers 214, 216, 218 and 220 and the input terminals of the registers 218, 220, 214 and 216, respectively.

The source driver 204 in the embodiment of the invention has a first mapping operation mode and a second mapping operation mode. Next, the first and second mapping operation modes will be described according to the following embodiments.

First Embodiment

Figure 3A:
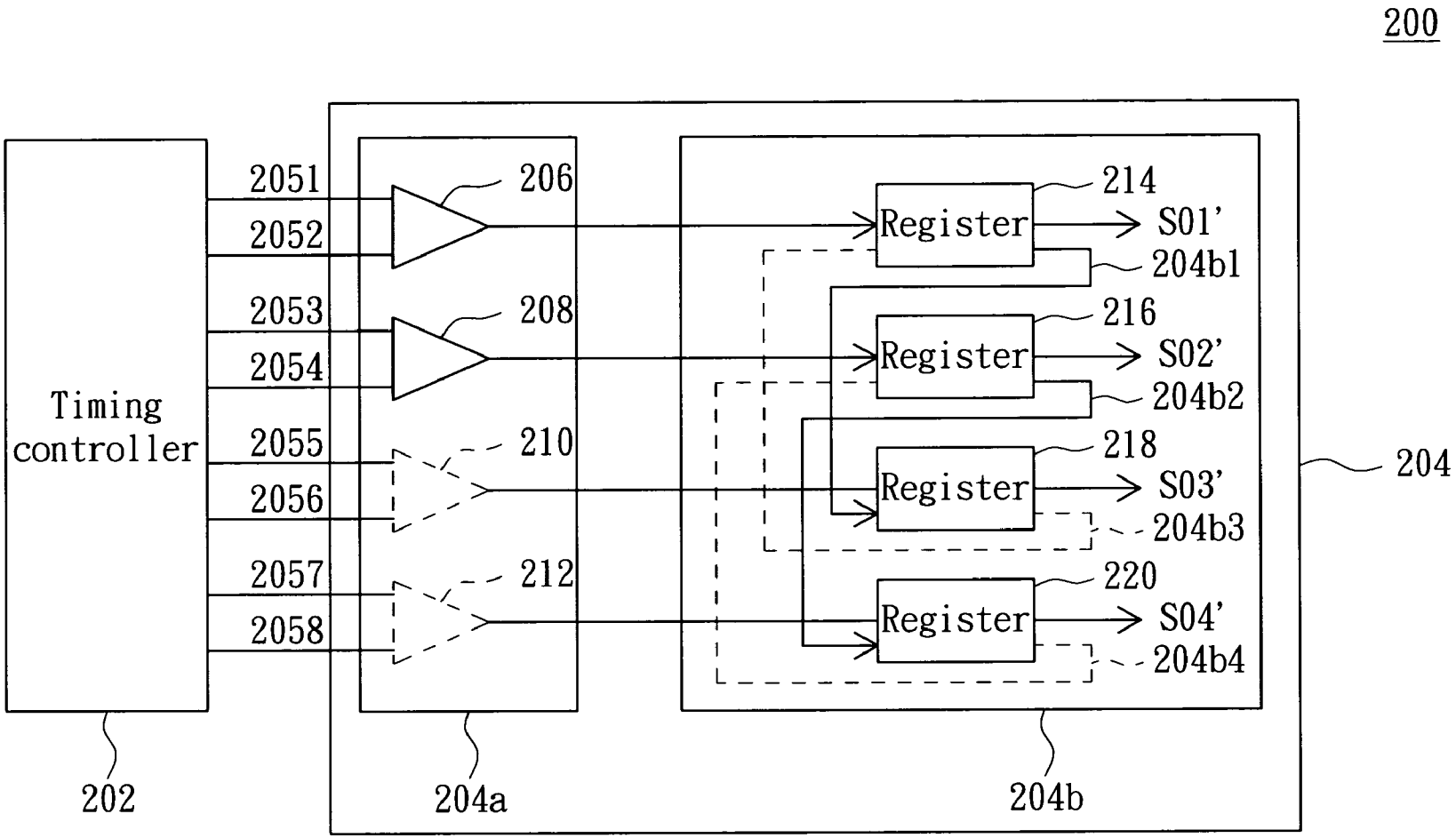
FIG. 3A shows a circuit layout of the timing controller 202 and the source driver 204 when the source driver 204 operates in the first mapping operation mode.

FIG. 3A shows a circuit layout of the timing controller 202 and the source driver 204 when the source driver 204 operates in the first mapping operation mode. As shown in FIG. 3A, when the source driver 204 operates in the first mapping mode, the receiving units 210 and 212 and the transmission paths 204*b*3 and 204*b*4 are disabled (the disabled receiving units 210 and 212 and the disabled transmission paths 204*b*3 and 204*b*4 are represented by dashed lines), and the transmission paths 204*b*1 and 204*b*2 are enabled. Thus, the timing controller 202 only can output the red sub-pixel data to the receiving units 206 and 208 through the buses 2051 to 2054, and the registers 214 and 216 are respectively coupled to the registers 218 and 220 in series.

Figure 3B:
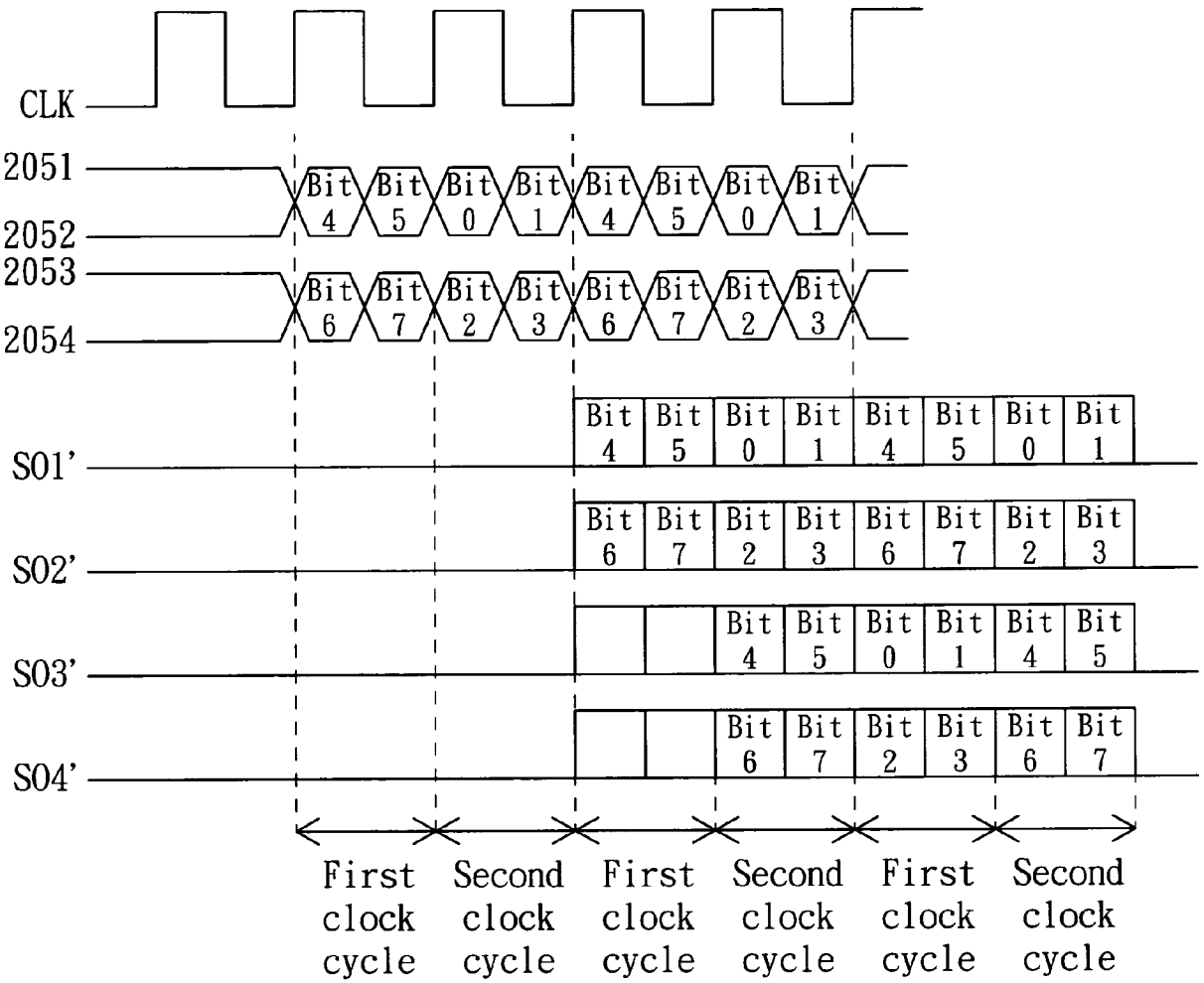
FIG. 3B shows timing charts of the bit data on the buses 2051 to 2054 when the source driver 204 operates in the first mapping operation mode.

FIG. 3B shows timing charts of the bit data on the buses 2051 to 2054 when the source driver 204 operates in the first mapping operation mode.

At a rising edge of a first clock cycle of the clock signal CLK, the timing controller 202 differentially inputs the bit data Bit4 and Bit6 to the receiving units 206 and 208 through the buses 2051 and 2052 and the buses 2053 and 2054, respectively. The receiving units 206 and 208 respectively store the bit data Bit4 and Bit6 to the registers 214 and 216. At a falling edge of the first clock cycle of the clock signal CLK, the timing controller 202 differentially inputs the bit data Bit5 and Bit7 to the receiving units 206 and 208 through the buses 2051 and 2052 and the buses 2053 and 2054, respectively. The receiving units 206 and 208 also respectively store the bit data Bit5 and Bit7 to the registers 214 and 216. Thus, the registers 214 and 216 respectively store the bit data Bit4 and Bit5 and the bit data Bit6 and Bit7 after the first clock cycle of the clock signal CLK.

At a rising edge of a second clock cycle of the clock signal CLK, the registers 214 and 216 output the bit data Bit4 and Bit6 to the registers 218 and 220 through the transmission paths 204*b*1 and 204*b*2, respectively. Meanwhile, the timing controller 202 differentially inputs the bit data Bit0 and Bit2 to the receiving units 206 and 208 through the buses 2051 and 2052 and the buses 2053 and 2054, respectively. The receiving units 206 and 208 respectively store the bit data Bit0 and Bit2 to the registers 214 and 216.

At a falling edge of the second clock cycle of the clock signal CLK, the registers 214 and 216 output the bit data Bit5 and Bit7 to the registers 218 and 220 through the transmission paths 204*b*1 and 204*b*2, respectively. Meanwhile, the timing controller 202 differentially inputs the bit data Bit1 and Bit3 to the receiving units 206 and 208 through the buses 2051 and 2052 and the buses 2053 and 2054, respectively. The receiving units 206 and 208 respectively store the bit data Bit1 and Bit3 to the registers 214 and 216. Consequently, the registers 214, 216, 218 and 220 respectively store the bit data Bit0 and Bit1, Bit2 and Bit3, Bit4 and Bit5 and Bit6 and Bit7 after the second clock cycle of the clock signal CLK.

Next, the registers 214 to 220 respectively output a plurality of output signals SO1' to SO4' during the next first clock cycle of the clock signal CLK. The output signals SO1' to SO4' respectively include the bit data Bit0, Bit2, Bit4 and Bit6 at the rising edge of the next first clock cycle of the clock signal CLK, and respectively include the bit data Bit1, Bit3, bit5 and Bit7 at the falling edge of the next first clock cycle of the clock signal CLK. Thus, the first mapping operation mode effectively achieves the data transmission between the timing controller 202 and the source driver 204 with the halved number of buses 2051 to 2054.

Figure 4A:
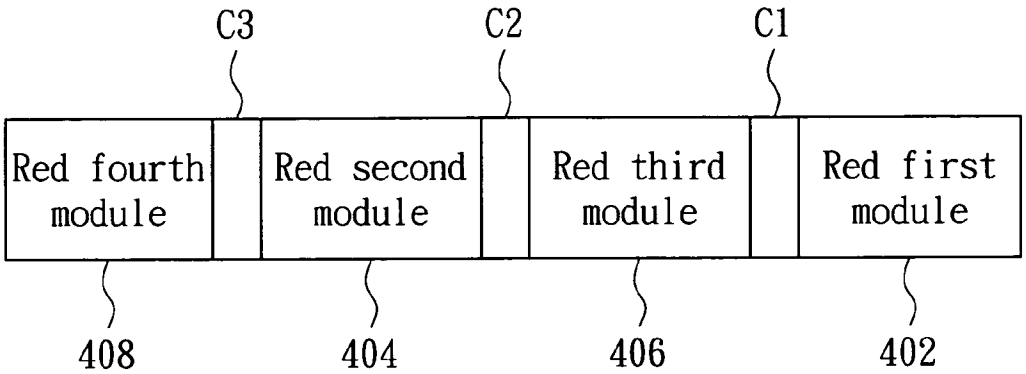
FIG. 4A is a schematic illustration showing a partial circuit layout of the LCD of FIG. 2.

FIG. 4A is a schematic illustration showing a partial circuit layout of the LCD of FIG. 2. In FIG. 4A, the circuit layout structure including a red first module 402, a red second module 404, a red third module 406 and a red fourth module 408 is depicted. The red first module 402 corresponds to the receiving unit 206 and the register 214, the red second module 404 corresponds to the receiving unit 208 and the register 216, the red third module 406 corresponds to the receiving unit 210 and the register 218, and the red fourth module 408 corresponds to the receiving unit 212 and the register 220. The red first to fourth modules 402 to 408 are arranged in the order of the red first module 402, the red third module 406, the red second module 404 and the red fourth module 408, and one capacitor is disposed between adjacent two red modules.

Figure 4B:
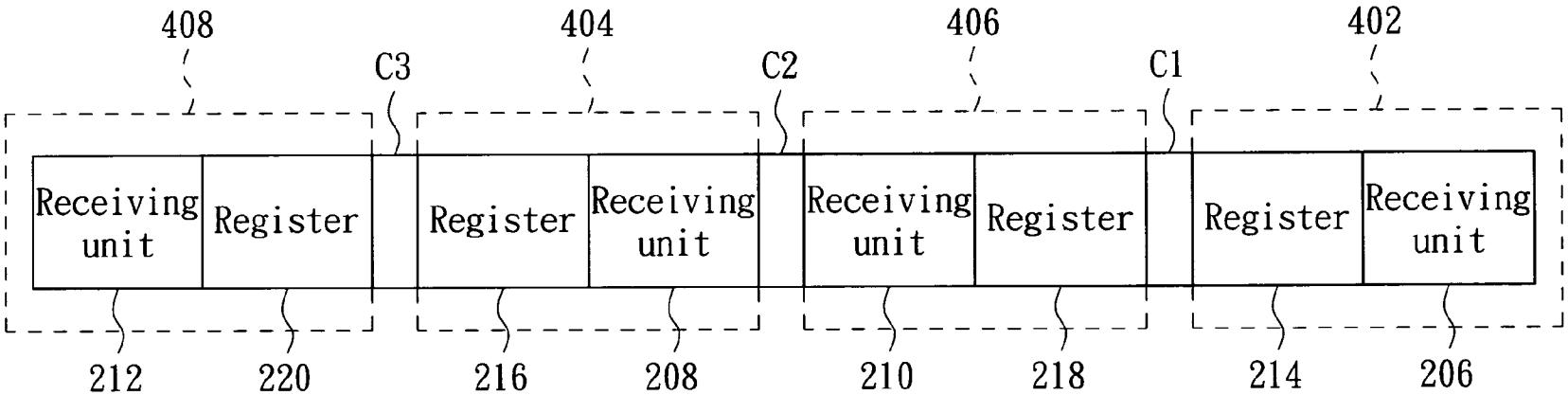
FIG. 4B is a schematic illustration showing a detailed circuit layout of the red first, second, third and fourth modules 402, 404, 406 and 408 in FIG. 4A.

FIG. 4B is a schematic illustration showing a detailed circuit layout of the red first, second, third and fourth modules 402, 404, 406 and 408 in FIG. 4A. As shown in FIG. 4B, the red first to fourth modules 402 to 408 respectively include the receiving units 206, 208, 210 and 212, and the red first to fourth modules 402 to 408 further include the registers 214 to 220, respectively. The circuit layout position of the register in each red module is adjacent to its corresponding transmission path.

The register 214 of the red first module 402 is adjacent to the register 218 of the red third module 406, and a capacitor C1 is disposed between the registers 214 and 218. The register 216 of the red second module 404 is adjacent to the register 220 of the red fourth module 408, and a capacitor C3 is disposed between the registers 216 and 220. The receiving unit 210 of the red third module 406 is adjacent to the receiving unit 208 of the red second module 404, and a capacitor C2 is disposed between the receiving units 210 and 208. Thus, when the source driver 204 operates in the first mapping operation mode, only the capacitors C1 and C2 are left on critical paths of the data transmission between the registers 214 and 218 and the registers 216 and 220. Consequently, lengths of the critical paths of the data transmission between the registers 214 and 218 and the registers 216 and 220 in the conventional source driver layout method may be shortened.

Figure 5:
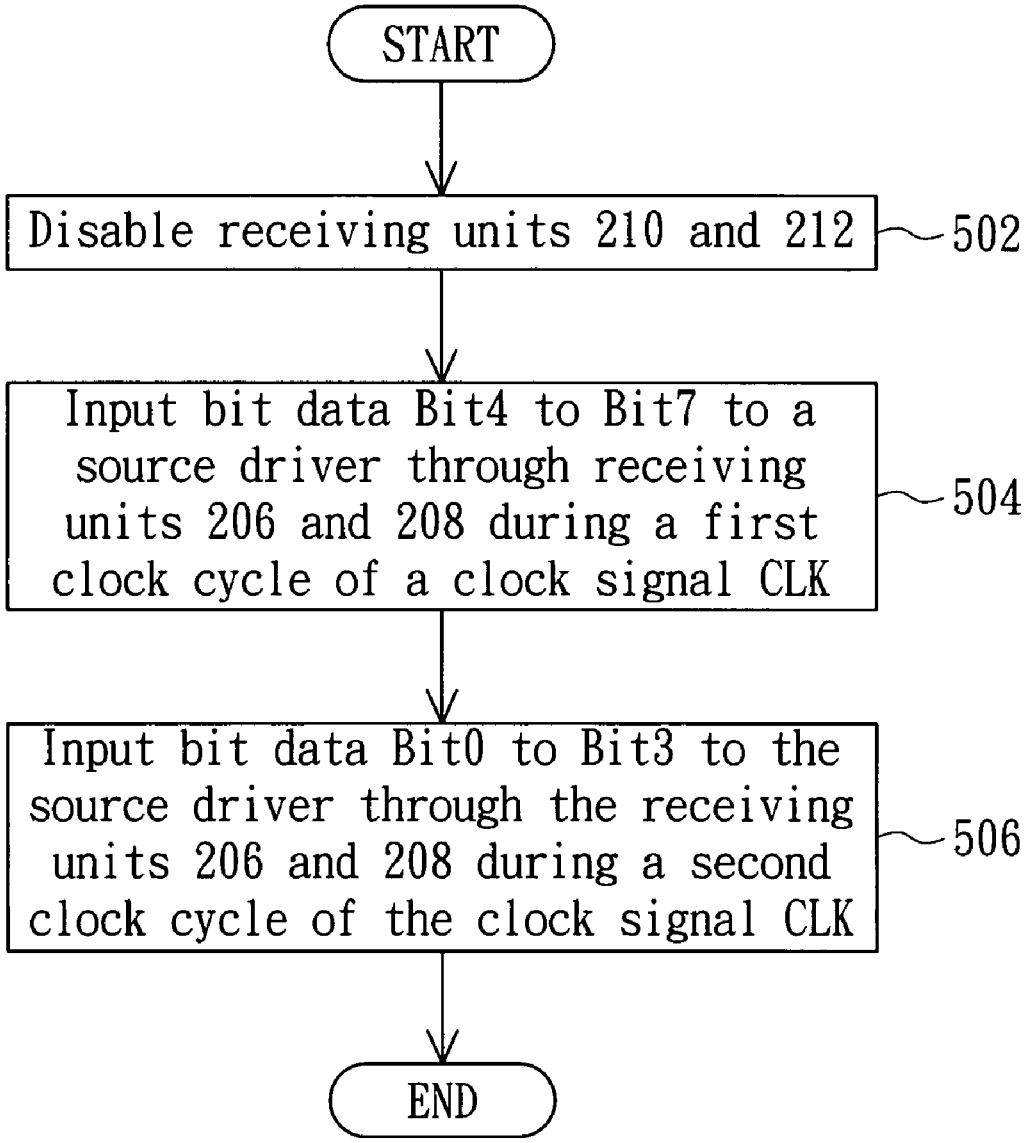
FIG. 5 is a flow chart showing a data transmitting method of the LCD 200 in accordance with the embodiment of the invention.

FIG. 5 is a flow chart showing a data transmitting method of the LCD 200 in accordance with the embodiment of the invention. Referring to FIG. 5, the data transmitting method of the LCD 200 of this embodiment includes the following steps.

First, as shown in step 502, the receiving units 210 and 212 are disabled.

Next, as shown in step 504, the bit data Bit4 and Bit5 are inputted to the register 214 through the buses 2051 and 2052 and the receiving unit 206 and the bit data Bit6 and Bit7 are inputted to the register 216 through the buses 2053 and 2054 and the receiving unit 208 during the first clock cycle of the clock signal CLK.

Thereafter, as shown in step 506, the bit data Bit0 and Bit1 are inputted to the register 214 through the buses 2051 and 2052 and the receiving unit 206, and the bit data Bit2 and Bit3 are inputted to the register 216 through the buses 2053 and 2054 and the receiving unit 208 during the second clock cycle of the clock signal CLK. Also, during the second clock cycle of the clock signal CLK, the bit data Bit4 and Bit5 are inputted to the register 218 through the transmission path 204*b*1, and the bit data Bit6 and Bit7 are inputted to the register 220 through the transmission path 204*b*2.

In this illustrated embodiment, the red sub-pixel data includes eight sets of bit data Bit0 to Bit7. However, the red sub-pixel data of this embodiment may also include more or less than eight sets of bit data, such as six sets of bit data. When the red sub-pixel data only includes six sets of bit data, for example, the timing controller 202 does not output the bit data Bit0 and Bit1 to perform the data transmission when the red sub-pixel data only includes six sets of bit data during the second clock cycle of the clock signal CLK.

In this illustrated embodiment, each pixel of the pixel array includes one red sub-pixel. However, each pixel of the pixel array of this embodiment may include multiple sub-pixels, such as the red, green and blue sub-pixels. Each color of sub-pixel may operate in a similar manner according to the operation of the red sub-pixel. In this illustrated embodiment, only the circuits, such as the circuit layout of the receiving units 206 to 212 and the registers 214 to 220, relating to the transmission of the red sub-pixel data are described. However, the circuit layouts for the transmission of other colors of sub-pixel data may also be derived in a similar manner according to the circuit layout of the circuit relating to the red sub-pixel data.

The receiving units 206 to 212 according to this embodiment are, for example, double edge sampling receiving units for sampling the bit data on the buses 2051 to 2058 at the rising edge and the falling edge of the clock signal CLK. The buses 2051 to 2058 according to this embodiment are, for example, reduced swing differential signal (RSDS) buses, which may be paired to form differential channels for differentially transmitting the signals.

The source driver 204 of this embodiment differs from the conventional source driver in that the source driver 204 of this embodiment needs two clock cycles of the clock signal CLK to receive eight sets of bit data of one sub-pixel data. Thus, in order to make the LCD have the source driver of this embodiment and the conventional LCD have the similar displaying effect, the frequency of the clock signal CLK of this embodiment is twice that of the clock signal of the conventional LCD. For example, when the frame frequency of the LCD 200 is 60 Hz, the frequency of the clock signal CLK is 90 MHz.

According to the first embodiment, the source driver 204 may perform the data transmission between the timing controller 202 and the source driver 204 with the halved number of buses. Meanwhile, the source driver 204 of this embodiment only needs two clock cycles of the clock signal CLK to completely receive the eight sets of bit data because the number of the used buses is halved.

Second Embodiment

Figure 6A:
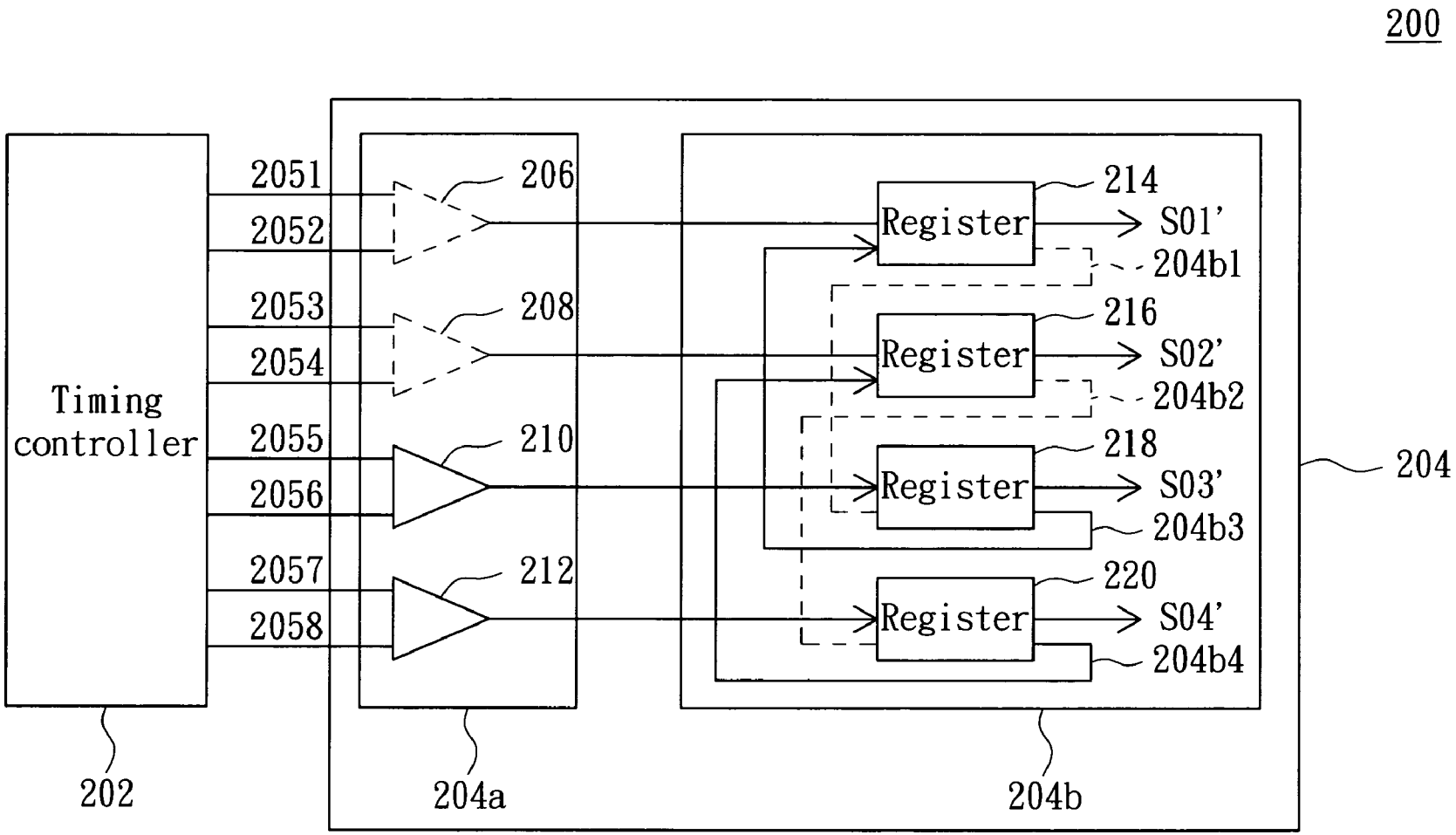
FIG. 6A shows a circuit layout of the timing controller 202 and the source driver 204 when the source driver 204 operates in the second mapping operation mode.

FIG. 6A shows a circuit layout of the timing controller 202 and the source driver 204 when the source driver 204 operates in the second mapping operation mode. As shown in FIG. 6A, the source driver 204 operating in the second mapping operation mode differs from the source driver 204 operating in the first mapping operation mode because the disabled receiving units and data transmission paths are different from each other. Meanwhile, the bit data Bit0 to Bit7 outputted from the timing controller 202 are received through different buses. When the source driver 204 operates in the second mapping operation mode, the receiving units 206 and 208 and the transmission paths 204*b*1 and 204*b*2 are disabled (the disabled receiving units 206 and 208 and the disabled transmission paths 204*b*3 and 204*b*4 are represented by dashed lines). In addition, the transmission paths 204*b*3 and 204*b*4 are enabled.

Figure 6B:
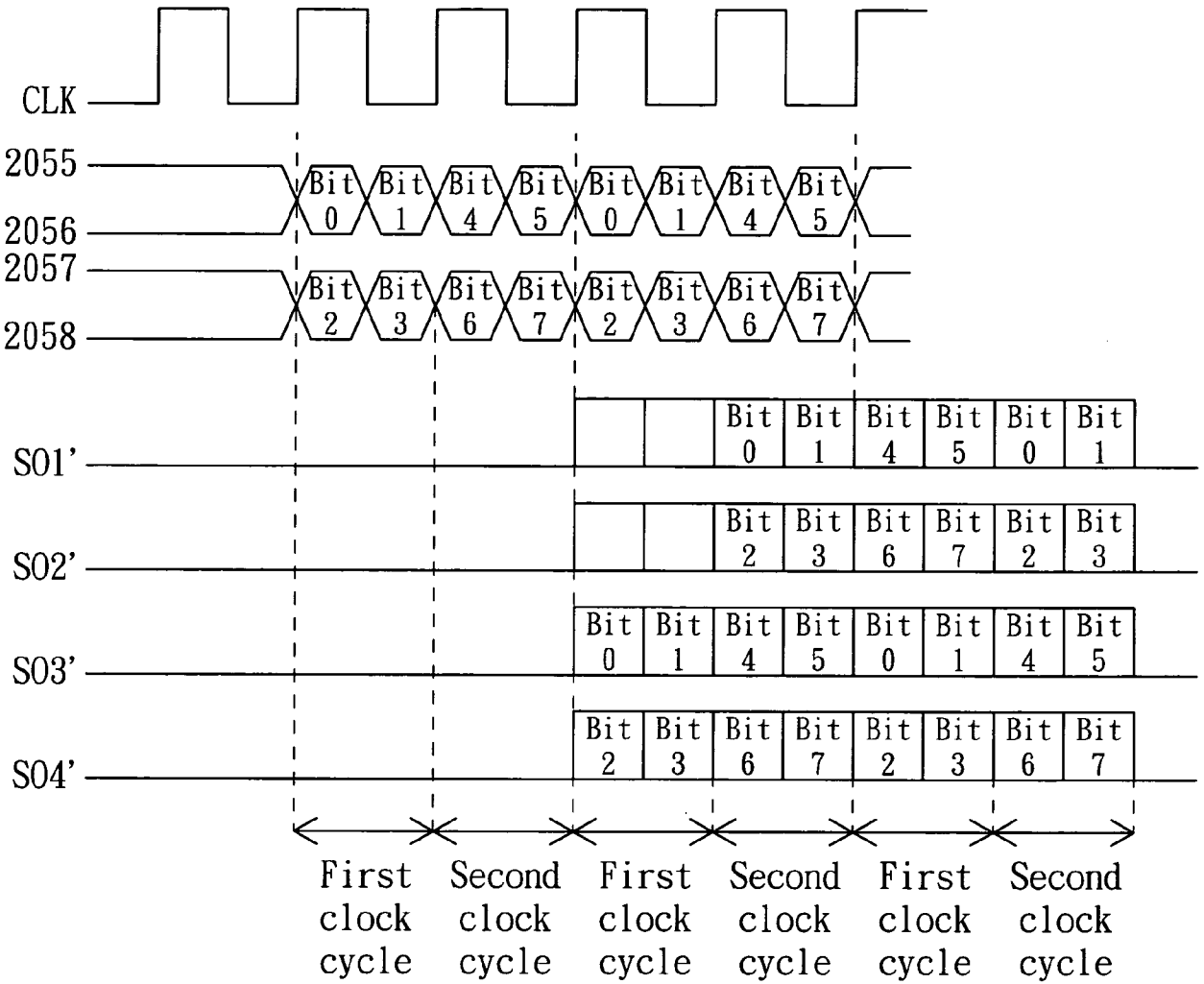
FIG. 6B shows timing charts of the bit data on the buses 2055 to 2058 when the source driver 204 operates in the second mapping operation mode.

FIG. 6B shows timing charts of the bit data on the buses 2055 to 2058 when the source driver 204 operates in the second mapping operation mode. As shown in FIG. 6B, the source driver 204 operating in the first mapping operation mode differs from the source driver operating in the second mapping mode in the order of receiving the bit data when the red sub-pixel data is received. The buses 2055 and 2056 and the buses 2057 and 2058 respectively input the bit data Bit0 and Bit1 and the bit data Bit2 and Bit3 to the receiving units 210 and 212 during the first clock cycle of the clock signal CLK, and the buses 2055 and 2056 and the buses 2057 and 2058 respectively input the bit data Bit4 and Bit5 and the bit data Bit6 and Bit7 to the receiving units 210 and 212 during the second clock cycle of the clock signal CLK.

At this time, the data transmitting method in the LCD 200 of FIG. 6A differs from the transmitting method of the first embodiment in the following aspects.

First, in the step 502 of FIG. 5, the receiving units 206 and 208 are disabled.

Next, in the step 504 of FIG. 5, the bit data Bit0 and Bit1 are inputted to the register 218 through the buses 2055 and 2056 and the receiving unit 210, and the bit data Bit2 and Bit3 are inputted to the register 220 through the buses 2057 and 2058 and the receiving unit 212 during the first clock cycle of the clock signal CLK.

Then, in the step 506 of FIG. 5, the bit data Bit4 and Bit5 are inputted to the register 218 through the buses 2055 and 2056 and the receiving unit 210, and the bit data Bit6 and Bit7 are inputted to the register 220 through the buses 2057 and 2058 and the receiving unit 212 during the second clock cycle of the clock signal CLK. During the second clock cycle of the clock signal CLK, the bit data Bit0 and Bit1 are inputted to the register 214 through the transmission path 204*b*3, and the bit data Bit2 and Bit3 are inputted to the register 216 through the transmission path 204*b*4.

The source driver 204 of this embodiment further includes a conventional mapping operation mode. When the source driver 204 operates in the conventional mapping operation mode, the transmission paths 204*b*1 to 204*b*4 are disabled and the receiving units 206 to 212 are enabled. At this time, the source driver 204 performs the data transmission between the timing controller 202 and the source driver 204 through the receiving units 206 to 212 and the buses 2051 to 2058. In addition, the source driver 204 of the above-mentioned embodiment further includes a selection pin (not shown) for switching the operation mode of the source driver 204 to the first mapping operation mode, the second mapping operation mode or the conventional mapping operation mode. The embodiments are illustrated by taking the source driver and the method for transmitting the sub-pixel data including eight sets of bit data as an example. However, the sub-pixel data is not restricted to the eight sets of bit data. For example, the sub-pixel data may include six sets of bit data.

The source driver according to the invention can receive the sub-pixel data outputted from the timing controller through the halved number of receiving units in the disabled receiver and the halved number of buses during two clock cycles of the clock signal. Thus, the LCD with the source driver according to the embodiments of the invention can reduce the layout area of the buses on the printed circuit board (PCB) so that the LCD with the source driver according to the embodiments of the invention advantageously has the lower cost and the lower output loading of the timing controller. The source driver according to the embodiments of the invention further has the conventional mapping operation mode. Meanwhile, when the source driver in the embodiments of the invention is operating in the first or second mapping operation mode, the bit data can be received according to the specific bit data mapping method so that the source driver of the invention further has the advantage of being applied to the conventional LCD architecture.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A source driver applied to a liquid crystal display (LCD), wherein the LCD comprises a pixel array having pixels each comprising one sub-pixel, and sub-pixel data of the sub-pixel comprises first bit data and second bit data, the source driver comprising:

a receiver, which comprises a first receiving unit and a second receiving unit, for receiving the first bit data and the second bit data and outputting the first bit data and the second bit data a line buffer comprising a first register and a second register, which respectively correspond to the first receiving unit and the second receiving unit and is for respectively receiving the first bit data and the second bit data outputted from the receiver;

a first transmission path for selectively electrically connecting an output terminal of the first register to an input terminal of the second register; and a second transmission path to be electrically connected to an output terminal of the second register and an input terminal of the first register, wherein, the source driver has a first mapping operation mode, and when the source driver operates in a first mapping operation mode, the second transmission path is disabled;

the source driver further has a second mapping operation mode, and when the source driver operates in the second mapping operation mode, the first receiving unit is disabled, the second receiving unit is enabled to receive the first bit data and the second bit data, the second transmission path is enabled to input the first bit data received by the second receiving unit to the first register, and the first transmission path is disabled.

2. The source driver according to claim 1, wherein:

when the source driver operates in the first mapping operation mode, the second receiving unit is disabled, the first receiving unit is enabled to receive the first bit data and the second bit data, and the first transmission path is enabled to input the second bit data received by the first receiving unit to the second register.

3. The source driver according to claim 1, further comprising:

a selection pin for switching an operation mode of the source driver to the first mapping operation mode or the second mapping operation mode.

4. The source driver according to claim 1, wherein the first receiving unit and the first register form a first module, the second receiving unit and the second register form a second module, and the registers of the first module and the second module are adjacent to each other in a layout of the source driver.

5. The source driver according to claim 1, wherein:

the sub-pixel data further comprises third bit data and fourth bit data;

the receiver further comprises a third receiving unit and a fourth receiving unit for receiving the third bit data and the fourth bit data and outputting the third bit data and the fourth bit data;

the line buffer further comprises a third register and a fourth register for respectively receiving the third bit data and the fourth bit data outputted from the receiver; and the source driver further comprises a third transmission path for selectively electrically connecting an output terminal of the third register to an input terminal of the fourth register.

6. The source driver according to claim 5, wherein when the source driver operates in a first mapping operation mode, the fourth receiving unit is disabled, the third receiving unit is enabled to receive the third bit data and the fourth bit data, and the third transmission path is enabled to input the fourth bit data received by the third receiving unit to the fourth register.

7. The source driver according to claim 6, further comprising a fourth transmission path for electrically connecting an output terminal of the fourth register to an input terminal of the third register, wherein:

when the source driver operates in a second mapping operation mode, the third receiving unit is disabled, the fourth receiving unit is enabled to receive the third bit data and the fourth bit data, and the fourth transmission path is enabled to input the third bit data received by the fourth receiving unit to the third register.

8. The source driver according to claim 7, wherein the first receiving unit and the first register form a first module, the second receiving unit and the second register form a second module, the third receiving unit and the third register form a third module, the fourth receiving unit and the fourth register form a fourth module, and the registers of the first module and the second module are adjacent to each other, and the registers of the third module and the fourth module are adjacent to each other in a layout of the source driver.

9. A liquid crystal display (LCD), comprising:

a pixel array having pixels each comprising a sub-pixel;

a timing controller for outputting sub-pixel data of the sub-pixel, the sub-pixel data comprising first bit data and second bit data; and a plurality of source drivers, each of which comprises:

a receiver comprising a first receiving unit and a second receiving unit for receiving the first bit data and the second bit data and outputting the first bit data and the second bit data, a line buffer comprising a first register and a second register, which respectively correspond to the first receiving unit and the second receiving unit, and respectively receive the first bit data and the second bit data outputted from the receiver, a first transmission path for selectively electrically connecting an output terminal of the first register to an input terminal of the second register, and a second transmission path for electrically connecting an output terminal of the second register to an input terminal of the first register, wherein, the source driver has a first operation mode, when the source driver operates in the first mapping operation mode, the second transmission path is disabled;

the source driver further has a second mapping operation mode, when the source driver operates in the second mapping operation mode, the first receiving unit is disabled, the second receiving unit is enabled to receive the first bit data and the second bit data, the second transmission path is enabled to input the first bit data received by the second receiving unit to the first register, and the first transmission path is disabled.

10. The LCD according to claim 9, wherein:

when the source driver operates in the first mapping operation mode, the second receiving unit is disabled, the first receiving unit is enabled to receive the first bit data and the second bit data, and the first transmission path is enabled to input the second bit data received by the first receiving unit to the second register.

11. The LCD according to claim 9, wherein the source driver further comprises: a selection pin for switching an operation mode of the source driver to the first mapping operation mode or the second mapping operation mode.

12. The LCD according to claim 9, wherein the first receiving unit and the first register form a first module, the second receiving unit and the second register form a second module, and the registers of the first module and the second module are adjacent to each other in a layout of the source driver.

13. The LCD according to claim 9, wherein:

the sub-pixel data further comprises third bit data and fourth bit data;

the receiver further comprises a third receiving unit and a fourth receiving unit, which are for receiving the third bit data and the fourth bit data and outputting the third bit data and the fourth bit data;

the line buffer further comprises a third register and a fourth register, which are for respectively receiving the third bit data and the fourth bit data outputted from the receiver; and the source driver further comprises a third transmission path for selectively electrically connecting an output terminal of the third register to an input terminal of the fourth register.

14. The LCD according to claim 13, wherein when the source driver operates in a first mapping operation mode, the fourth receiving unit is disabled, the third receiving unit is enabled to receive the third bit data and the fourth bit data, and the third transmission path is enabled to input the fourth bit data received by the third receiving unit to the fourth register.

15. The LCD according to claim 14, wherein:

the source driver further comprises a fourth transmission path for electrically connecting an output terminal of the fourth register to an input terminal of the third register; and when the source driver operates in a second mapping operation mode, the third receiving unit is disabled, the fourth receiving unit is enabled to receive the third bit data and the fourth bit data, and the fourth transmission path is enabled to input the third bit data received by the fourth receiving unit to the third register.

16. The LCD according to claim 15, wherein the first receiving unit and the first register form a first module, the second receiving unit and the second register form a second module, the third receiving unit and the third register form a third module, the fourth receiving unit and the fourth register form a fourth module, the registers of the first module and the second module are adjacent to each other, and the registers of the third module and the fourth module are adjacent to each other in a layout of the source driver.

17. A data transmitting method applied to a data transmission interface for inputting a data signal from a timing controller to a source driver, the data signal comprising a first set of data and a second set of data, the source driver comprising a first receiving unit, a second receiving unit, a third receiving unit and a fourth receiving unit, and corresponding first to fourth registers, the method comprising the steps of:

(a) disabling the first receiving unit and the second receiving unit;

(b) inputting the first set of data to the source driver through the third receiving unit and the fourth receiving unit and inputting the first set of data to the third register and the fourth register during a first clock cycle of a clock signal; and (c) inputting the second set of data to the source driver through the third receiving unit arid the fourth receiving unit, and inputting the second set of data to the third register and the fourth register while inputting the first set of data stored in the third register and the fourth register to the first register and the second register during a second clock cycle of the clock signal, so as to achieve data transmission between the timing controller and the source driver with halved number of the first to the fourth receiving units spared.

18. The method according to claim 17, wherein the data signal comprises first bit data, second bit data, third bit data, fourth bit data, fifth bit data, sixth bit data, seventh bit data and eighth bit data, and the first to eighth bit data are bit sequences arranged in order.

19. The method according to claim 18, wherein the first set of data comprises the first to fourth bit data, and the second set of data comprises the fifth to eighth bit data.

20. The method according to claim 19, wherein the third receiving unit receives the first and second bit data, and the fifth and sixth bit data during the first and second clock cycles, respectively, and the fourth receiving unit receives the third and fourth bit data, and the seventh and eighth bit data during the first and second clock cycles, respectively.

21. The method according to claim 18, wherein the first set of data comprises the fifth to eighth bit data, and the second set of data comprises the first to fourth bit data.

22. The method according to claim 21, wherein the third receiving unit receives the fifth and sixth bit data, and the first and second bit data during the first and second clock cycles, respectively, and the fourth receiving unit receives the seventh and eighth bit data, and the third and fourth bit data during the first and second clock cycles, respectively.

23. The method according to claim 17, wherein in the steps (b) and (c), the third receiving unit and the fourth receiving unit are double edge sampling receiving units for sampling the first set of data and the second set of data at a rising edge and a falling edge of the clock signal.

24. The method according to claim 17, wherein the data signal is a sub-pixel data signal of a display.

25. The method according to claim 17, wherein the data signal is outputted from a timing controller.

26. The method according to claim 17, wherein the data transmission interface is a data transmission interface for a reduced swing differential signal (RSDS) bus.

* * * * *